US005816407A

United States Patent [19]

Daratony

[11] Patent Number: 5,816,407

[45] Date of Patent: Oct. 6, 1998

[54] CHRISTMAS DECORATION STORAGE ORGANIZER

[76] Inventor: Ronald A. Daratony, 13237 Brainbridge, Warren, Mich. 48089

[21] Appl. No.: 927,240

[22] Filed: Sep. 11, 1997

[51] Int. Cl.[6] ..... B65D 85/42

[52] U.S. Cl. ..... 206/576; 206/419

[58] Field of Search ..... 206/701, 702, 206/418, 419, 420, 576, 521, 583, 594

[56] References Cited

U.S. PATENT DOCUMENTS

| | | | |
|---|---|---|---|
| 5,033,619 | 7/1991 | Garis . | |
| 5,064,067 | 11/1991 | McAllister . | |
| 5,317,491 | 5/1994 | Lee . | |
| 5,526,931 | 6/1996 | White . | |
| 5,653,339 | 8/1997 | Dobson | 206/419 X |
| 5,667,072 | 9/1997 | Chang | 206/576 X |

*Primary Examiner*—Jacob K. Ackun

*Attorney, Agent, or Firm*—Kenneth L. Tolar

[57] ABSTRACT

The present invention relates to a Christmas light and ornament storage device designed to prevent light strands from tangling. The device comprises a box shaped carrier having a bottom surface, four side walls depending therefrom and an open top. An interior box dimensioned slightly smaller than the carrier is received therein. A plurality of removably attached tubular members vertically depend from the bottom surface some of which are received within the interior box and are arranged in two opposing parallel rows. Opposing pairs of the tubular members received within the interior box each are surrounded by continuous pieces of fabric which form parallel sidewalls. The area between the fabric walls and the interior box define a plurality of soft, flexible storage compartments for receiving fragile decorations. Christmas light strands may be wrapped around adjacent pairs of the tubular members disposed externally of the interior box to prevent the strands from being entangled. Each of the components attached to the carrier bottom surface may be removed as desired.

9 Claims, 2 Drawing Sheets

CHRISTMAS DECORATION STORAGE ORGANIZER

BACKGROUND OF THE INVENTION

Christmas lights are typically stored in cardboard boxes where they are often broken or become hopelessly tangled. Christmas decorations, especially tree ornaments, are often extremely fragile and will usually break when subjected to the slightest amount of pressure. Therefore, whenever the fragile items are stored in a standard box until the following holiday season, they are usually broken by the weight of other items similarly stored unless each ornament is carefully wrapped in packing paper. Such a procedure is tedious and time consuming. The present invention relates to a unique storage device in which a plurality of Christmas light strings may be wrapped and stored so that the strings do not become tangled or broken. In addition, fragile decorations and ornaments may be placed in protective storage compartments having fabric side walls preventing the decorations from breaking.

DESCRIPTION OF THE PRIOR ART

Numerous light storage devices designed to minimize tangling of Christmas light strands exist in the prior art. None of these devices relate to a Christmas light holder having the features and advantages of the present invention; most notably, these devices do not have fabric type storage compartments designed to receive and protect fragile ornaments in a convenient, easy to handle box type carrying case. U.S. Pat. No. 5,064,067 issued to McAllister et al relates to a Christmas light organizer comprising a generally rectangular planar frame having two opposing sides with a series of tooth-like projections extending outwardly therefrom. A Christmas light strand may then be wrapped around the frame with the cord being received within adjacent projections.

U.S. Pat. No. 5,033,619 issued to Garis relates to a light string carrier including a lattice comprising a plurality of parallel elongated rectangular plates around which light strings may be wrapped. The lattice is stored within two hingedly engaging covers, one of which has a handle thereon.

U.S. Pat. No. 5,317,491 issued to Lee discloses a holder for a string of electric lights comprising a flat mounting plate on a side of which are first and second sets of mounting elements for securing a series of lamps and lamp sockets thereon. Third and fourth sets of mounting elements similar to the first and second sets may be mounted on an opposite side.

U.S. Pat. No. 5,526,931 issued to White discloses a Christmas light carrier including a base with a handle on each end configured to allow Christmas tree light strands to be wound thereon. The base has a plurality of arms extending from two opposing sides with cavities therebetween which receive the light strands. As indicated above, several devices exist which are designed to store and receive Christmas light strands. However, none of these devices have the features and advantages of the present invention, especially the fabric storage compartments designed to store and protect fragile Christmas ornaments.

SUMMARY OF THE INVENTION

The present invention relates to a storage device for Christmas lights and decorations comprising a hollow, box shaped carrier having four side walls and a bottom wall. A plurality of elongated tubular members vertically depend from and are removably attached to the bottom wall. A plurality of flat continuous pieces of fabric or a similar soft, flexible material are each wrapped around two opposing tubular components to form a plurality of storage compartments therebetween. The fabric storage compartments provide soft, flexible, protective enclosures for receiving fragile Christmas decorations and ornaments. Surrounding the fabric compartments is an interior box which provides an outer border for the ornament storage compartments. The interior box has a pair of integral storage compartments for receiving items such as tinsel, extension cords, etc. Attached to the box-shaped carrier is a hingedly engaging lid with handles on opposing sides and a snap style lip extending downwardly therefrom allowing the carrier to be selectively enclosed. It is therefore an object of the present invention to provide a single Christmas decoration storage device which allows Christmas light strands, ornaments and similar decorations to be easily stored therein.

It is yet another object of the present invention to provide a Christmas decoration storage device which prevents Christmas light strands from becoming tangled.

It is yet another object of the present invention to provide a Christmas decoration storage device which prevents fragile decorations from being broken.

It is yet another object of the present invention to provide a Christmas decoration storage device having removably attached interior components allowing a user to create various configurations. Other objects, features and advantages of the present invention will be readily apparent from the detailed description of the preferred embodiment when considered with the attached drawings and the appended claims.

DESCRIPTION OF THE PREFERRED EMBODIMENT

Figure 1:
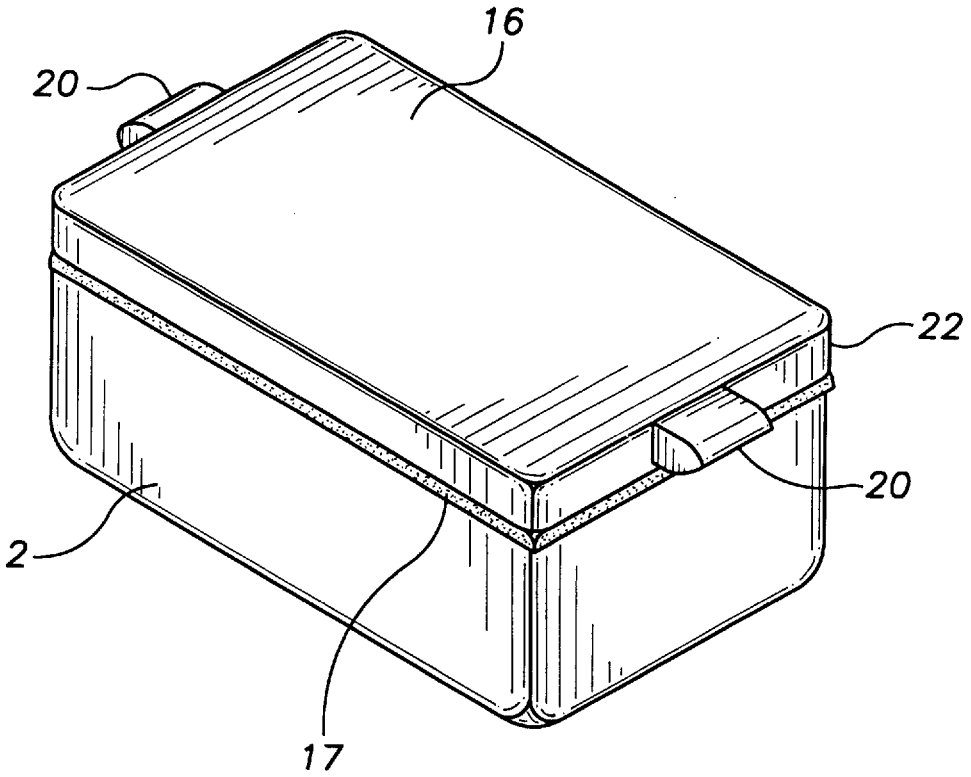
FIG. 1 depicts the inventive device with the lid closed.

Referring now to FIGS. 1 through 4, the present invention relates to a Christmas decoration storage device comprising a hollow, substantially box shaped carrier 1 having a bottom surface 3, four side walls 2 vertically depending therefrom and an open top. Vertically depending from and removably attached to the bottom surface 3 are a plurality of elongated tubular members 4. The tubular members 4 may be added or removed to create a desired configuration. Preferably, the tubular members 4 each have an annular rim 21 at a distal end for preventing items wrapped therearound from being displaced.

Received within the carrier 1 and attached to the bottom surface 3 is an interior box 18 having four side walls and open top and bottom ends. The interior box 18 is dimensioned to easily fit within the carrier such that an area of predetermined dimension between the interior box side walls and the carrier side walls is available for removably attaching a plurality of tubular members as described below. The interior box 18 has a dividing wall 8 depending perpendicularly from a side wall 6. Attached to a distal edge of the dividing wall 8 is an inner wall 7 substantially parallel to side wall 6. Opposing edges of the inner wall 7 are attached to or immediately adjacent to opposing side walls 9,10 of the interior box. The area between sides walls 6,9,10, dividing wall 8 and inner wall 7 defines a pair of substantially rigid storage compartments 12,13 for receiving Christmas ornaments, extension cords or similar items.

Figure 2:
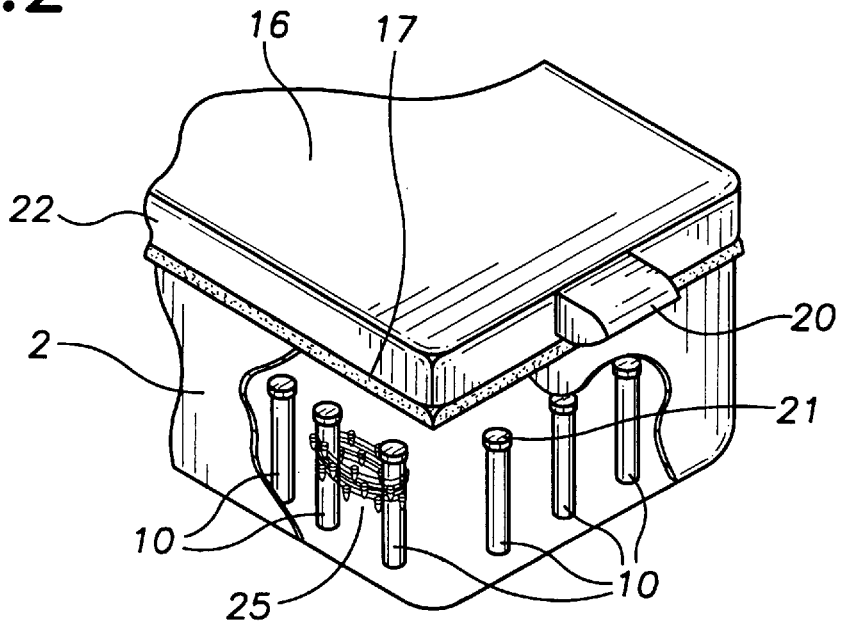
FIG. 2 is a cross sectional view of the box component interior with a Christmas strand wrapped around a pair of tubular members.
Figure 4:
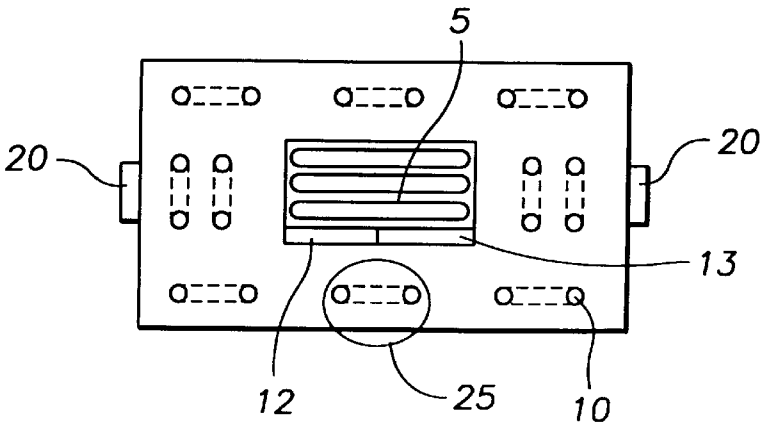
FIG. 4 is a top view of the device with the internal components received therein.
Figure 3:
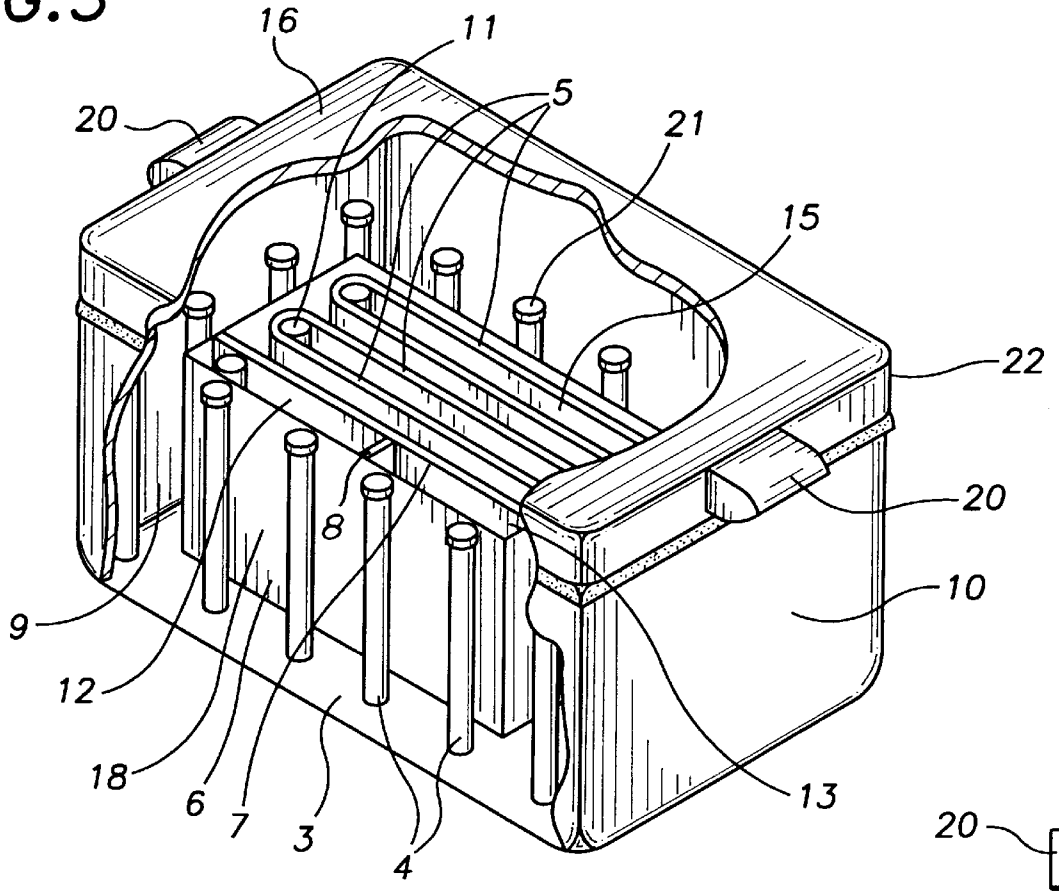
FIG. 3 is a cross sectional view of the inventive device with the fabric storage compartments therein.

A predetermined number of tubular members 11 are received within the interior box 18 and are arranged in two opposing parallel rows with each row adjacent and parallel to an opposing side wall of the interior box 18. The remainder of the tubular members 10 are disposed externally of the interior box 18. Preferably, the externally disposed tubular members 10 are arranged with at least one row proximal and parallel to each of the side walls 2 of the interior box to form a substantially square configuration as depicted in FIG. 3. However, as will be readily apparent to those skilled in the art, the tubular members 10 may be arranged in various other configurations as desired. Adjacent pairs of the external tube members 10 receive light strands as depicted in FIG. 2.

A plurality of continuous pieces of fabric 5 are each removably wrapped around two opposing inner 11 tubular members to form storage compartments 15 therebetween. Preferably, the fabric storage compartments 15 are parallel to the inner wall 7 of the interior box 18. The storage compartments 15 provide a soft, flexible storage space for receiving fragile Christmas decorations, ornaments and lights. Other materials which are capable of forming soft, flexible storage compartments may be substituted for the fabric pieces.

Hingedly engaging the exterior surface of a side wall 2 of the carrier 1 near its open top is a substantially rectangular lid 16 for selectively covering the open top. The lid 16 has four peripheral edges with walls 22 downwardly depending from the peripheral edges. Extending from each of the downwardly depending walls 22 is a lip 17 which tightly engages the exterior of the carrier side walls 22 when the lid 16 is in the closed position. Depending from opposing sides of the lid 16 are a pair of integral handles 20 allowing the container to be easily carried.

To use the device described above, the lid 16 is opened and any number of ornaments or decorations may be placed in the fabric storage compartments 15. One or more strands of Christmas lights 25 are wrapped around two adjacent, external tubular members 10 as depicted in FIG. 2. The lid 16 is snapped into the closed position and the device may be stored in a desired location.

If desired, a user may remove the fabric storage compartments, the interior box, any number of the tubular members or any combination thereof to create a desired configuration. Alternatively, all of the internal components may be removed and the device may be used as a storage box.

As will be readily apparent to those skilled in the art, the various components of the device other than the fabric side walls may be fabricated with any one of a number of materials such as plastic, rubber, vinyl or any other suitable material. The shapes and dimensions of the various components including the box shaped carrier may be varied to suit a particular application.

From the above description, it now apparent that the present invention relates to a storage device for storing Christmas lights, decorations and ornaments designed to prevent light strands from tangling and which is specially configured to receive and protect fragile items. Although there has been shown and described the preferred embodiment of the present invention, it will be apparent to those skilled in the art that modifications may be made thereto which do not exceed the scope of the appended claims. Accordingly, the device is only to be limited by the following claims.

What is claimed is:

1. A Christmas light and decoration storage device comprising:

a hollow carrier having a bottom surface, four side walls vertically extending therefrom and an open top;

an interior box component having four side walls, and open top and bottom ends, received within said carrier, said interior box dimensioned smaller than said carrier;

a plurality of tubular members vertically depending from said bottom surface, a predetermined number of which are disposed within said interior box and which are aligned in two, opposing parallel rows;

at least one continuous piece of fabric like material surrounding a pair of opposing tubular members disposed within the interior box to form a soft, flexible storage compartment for receiving fragile decorations and ornaments.

2. A device according to claim 1 wherein a predetermined number of said tubular members are disposed externally from said interior box for receiving strands of Christmas lights.

3. A device according to claim 1 wherein said interior box further comprises:

a dividing wall having first and second edges, a first edge of which is attached to a side wall of said interior box, said dividing wall being substantially perpendicular to said side wall of said interior box;

an inner wall attached to the second edge of said dividing wall, said inner wall being substantially parallel to said side wall of said interior box whereby the area between the side, inner and dividing walls define storage compartments for receiving various Christmas ornaments and decorations.

4. A device according to claim 1 further comprising a lid component, hingedly engaging a side wall of said carrier proximal its open top for selectively enclosing said carrier.

5. A device according to claim 1 wherein said tubular members are removably attached to said bottom surface.

6. A device according to claim 2 wherein said externally disposed tubular members are aligned with a row proximal and parallel to each side wall of said carrier to form a substantially rectangular configuration.

7. A device according to claim 4 wherein said lid component is substantially rectangular, and has four peripheral edges and four vertical walls each downwardly depending from one of said edges and a lip attached to a distal edge of said vertical walls to tightly engage the exterior surface of said carrier side walls when the lid is in a closed position.

8. A device according to claim 1 wherein said tubular members have a substantially circular integral rim at a distal end for preventing the fabric pieces, Christmas light strands or similar items wrapped therearound from being displaced from said tubular members.

9. A device according to claim 7 wherein said lid component further comprises a pair of handles attached to opposing edges of said lid.

* * * * *